US007066553B2

(12) United States Patent
Maloney

(10) Patent No.: US 7,066,553 B2
(45) Date of Patent: Jun. 27, 2006

(54) FURNITURE STRUCTURE

(75) Inventor: Timothy J. Maloney, Louisville, KY (US)

(73) Assignee: Fincastle County Chairworks, LLC, Louisville, KY (US)

( * ) Notice: Subject to any disclaimer, the term of this patent is extended or adjusted under 35 U.S.C. 154(b) by 0 days.

(21) Appl. No.: 10/427,727

(22) Filed: Apr. 30, 2003

(65) Prior Publication Data

US 2004/0000808 A1 Jan. 1, 2004

Related U.S. Application Data

(60) Provisional application No. 60/376,891, filed on May 1, 2002.

(51) Int. Cl.
*A47C 7/42* (2006.01)

(52) U.S. Cl. ..... 297/452.63; 297/440.2; 297/440.22

(58) Field of Classification Search ..... 297/452.63, 297/452.64, 440.1, 440.2, 440.22
See application file for complete search history.

(56) References Cited

U.S. PATENT DOCUMENTS 42,150 A * 3/1864 Wood ..... 297/447.4
233,478 A * 10/1880 Creager ..... 297/447.4
1,246,544 A * 11/1917 Chassaing ..... 5/187
2,839,126 A * 6/1958 O'Neill ..... 160/392
3,175,269 A * 3/1965 Raduns et al. ..... 24/265 C
3,399,926 A 9/1968 Hehn
3,590,901 A 7/1971 Dubinsky
3,909,064 A * 9/1975 Payne et al. ..... 297/440.23
4,456,301 A 6/1984 Apissomian
4,730,872 A 3/1988 Golzor
4,910,817 A 3/1990 Kita
5,275,467 A * 1/1994 Kawecki ..... 297/440.13
5,387,027 A 2/1995 Maloney
5,769,500 A 6/1998 Holbrook
5,836,655 A * 11/1998 Laufer ..... 297/452.63
6,056,367 A 5/2000 Hsiao
6,644,750 B1 * 11/2003 Sandman et al. ..... 297/440.21

* cited by examiner

*Primary Examiner*—Peter R. Brown
(74) *Attorney, Agent, or Firm*—Carrithers Law Office, PLLC; David W. Carrithers

(57) ABSTRACT

Slat furniture generally of the outdoor type having a pair of laterally spaced apart supports and slats disposed there between and connected thereto and in which the slats individually or in groups are snap fittingly connected to the supports in a rigid manner such that the furniture is rigid without the need for further reinforcement. The slats, or slat units are selectively resilient and connected to the supports by fingers projecting therefrom into recesses in the supports. A snug close fit relation gives rigidity which is further enhance by contiguous slat sections being angularly disposed with respect to one another.

18 Claims, 5 Drawing Sheets

FIG.18

FURNITURE STRUCTURE

This application claims priority from U.S. Provisional Application Ser. No. 60/376,891 filed on May 1, 2002 whereby the entire application is incorporated in its entirety herein.

FIELD OF INVENTION

This invention relates generally to outdoor patio type furniture and more particularly to interlock connections between the occupant engageable portion of the furniture and the support for such portion of the furniture.

BACKGROUND OF THE INVENTION

Furniture is bulky in the assembled for use state. Transportation thus becomes a problem and as a result thereof many pieces of furniture, particularly patio and outdoor furniture, is manufactured and shipped in a flat knock down state and then assembled at the place of sale or end use. The applicant has for several years designed and made furniture that can be readily assembled when shipped flat. Applicant has successfully for a number of years marketed furniture covered by U.S. Pat. No. 5,387,027 issued on Apr. 1, 1993. The furniture disclosed therein requires no tools or hardware for assembly. The instant application describes and claims improvements providing means for resilience or variable resilience. There are several patents relating to outdoor patio furniture which is considered pertinent to the instant disclosure.

Hsiao's U.S. Pat. No. 6,056,367 issued May 2, 2000 discloses a seat strap made soft by filing with foam but not variable thickness and or width. Holbrook's U.S. Pat. No. 5,769,500 issued Jun. 23, 1998 discloses non-structural slats that have common edges but requires structural members in addition. Kita's U.S. Pat. No. 4,910,817 issued Mar. 27, 1990 discloses a resilient seat locked to the chair frame via a metal rod insert. Golzer's U.S. Pat. No. 4,730,872 issued Mar. 15, 1998 discloses triangular in cross section straps joined to common supports rather than integral. There is edge support only at the top and bottom and not from side to side. Apissomian's U.S. Pat. No. 4,456,301 issued Jun. 26, 1984 discloses a quick method of attaching straps in pairs only. Dublasky's U.S. Pat. No. 3,590,901 issued Jul. 6, 1971 and discloses resilient slats held in place individually by a common rod. Hehn's U.S. Pat. No. 3,399,926 issued Sep. 3, 1968 and discloses common seat elements with a joining bar inserted into a pocket in the seat element.

SUMMARY OF INVENTION

Disclosed herein are new furniture structures that increase comfort, enhance durability and to do so in ways which can be incorporated in a wider variety of styles. The combination, in seats and backs, of seating, of resilience for comfort with sufficient structural rigidly is of great importance. Doing so in combination with durable, low cost means of connections is important in this work. Lowering cost results from these novel combinations.

Most of the furniture disclosed herein has been built and tested by the applicant. The pieces for the furniture are either molded or machined from flat sheets of plywood, plastics material including a titanium resin alloy sold under the Trademark ANDURE® and other sheet goods. Applicant's experience has led to further innovations to increase quality, broaden compatibility with different styles of furniture, increase durability and/or reduce cost. The titanium resin alloy referred to above is a special formulation of polypropylene developed by the present applicant and which gives long term durability for furniture in outdoor weather conditions. It combines the structure and surface finish of and is essentially identical from the outside to the center of the board.

A particular object of applicant's developmental work in this field of furniture design has been to find new ways to interlock the various components which make up the structure of the furniture, to minimize the need for fasteners, welds and the like, and to find new ways to utilized materials having low flexural modulus (stiffness).

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF PREFERRED EMBODIMENTS

Figure 1:
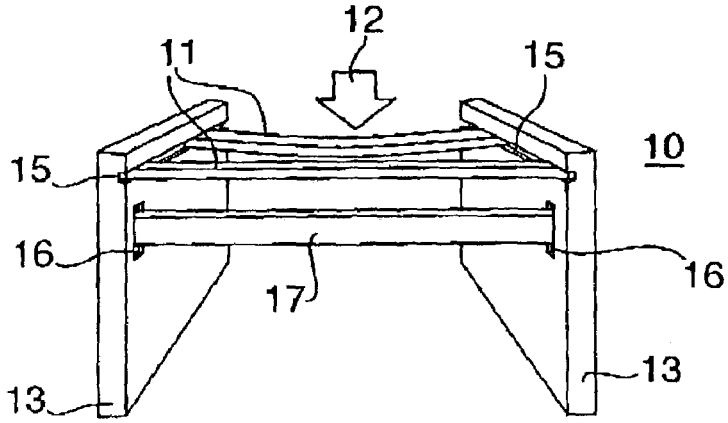
FIG. 1 in perspective view diagrammatically illustrating the inter-connection of the slats of a piece of furniture and the support structure for such slats in which the slats are the part engaged by the occupant for example while sitting on of the piece of furniture.

Referring to the drawings, there is diagrammatically illustrated in FIG. 1 an assembled piece of furniture 10 comprising a plurality of load bearing straps or slats 11 on which a person or other object exerts force 12, i.e. by sitting or resting thereon. At least some or all of the slats, as will become more apparent hereinafter, have the opposite ends thereof snap fittingly connected to respective ones of a spaced apart pair of supports 13 that maybe legs, rails or the like portion of a piece of furniture. The interconnection comprises an end portion of the slat projecting into a cavity in the support and with respective inter-engaging formations cooperate to provide a self locking snap in interconnection upon assembly. The cavity in the support shown in FIG. 1 comprises an elongate groove 15 extending horizontally and a cavity or groove 16 that is vertical or has a vertical portion extending downwardly from the slat forming seat portion of the piece of furniture. If desired the groove 16 can be a continuation of the groove 15 (see FIGS. 14 and 19). The groove 15 can be a straight line as illustrated in FIG. 1 or have a curvature thereto as illustrated by way of example in FIGS. 14 and 19.

The slats 11 have sufficient resiliency to provide an enhanced degree of comfort by conforming to the anatomy of a person sitting thereon. This results in part from use of a low flexural modulus, relative to wood, material for the construction of the slats. Central to the invention is the simultaneous ability of these resilient slats 11 to provide the necessary structure to keep the supports adequately oriented to carry out their support function. The slats thus provide both resilience and side-to-side structural support. Popular strap seat furniture requires, for example a pair of aluminum sides held in the proper relation to one another by several horizontal structural bars typically welded to the sides. Contrary to this the invention herein provides either or both of those functions. When one slat is deployed at an angle from the sit on slats, i.e. off-set from the plane of the sit on slats, for example slat 17, additional stiffening of the support sides 13 is accomplished.

Figure 2:
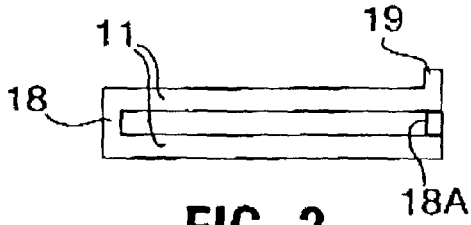
FIG. 2 is a plan view of a pair of spaced apart parallel straps.

Shown in FIG. 2 are two spaced apart parallel slats 11, machined or molded, and interconnected to provide a single unit in which the two are joined at the ends thereof by an integral or applied connector 18. The connecting portion illustrated at 18A is of reduced thickness i.e. thinned or reduced to such thickness, taking into account the rigidity of the material, as to provide the ability of tilting one strap relative to the next whereby a series of the straps can be bent around a corner for comfort of the occupant and/or accomplish the said additional stiffening. The unit described in the forgoing may have spacers 19 appended to facilitate the spaced relationship of the strap units.

Figure 3:
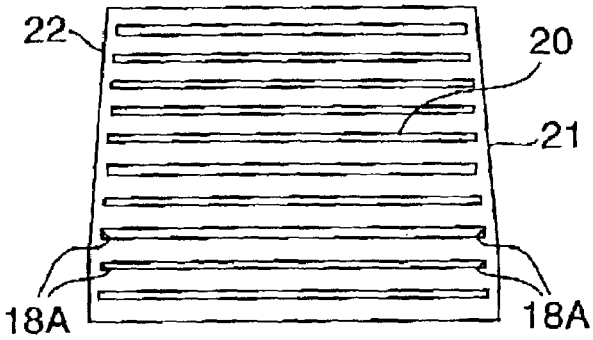
FIG. 3 is a plan view of seat or back consisting of a plurality of spaced apart parallel slats.

FIG. 3. is a plan view of a seat, or back, as the case maybe, manufactured as a single unit 20 and comprising a plurality of spaced apart parallel slats 11 joined at opposite ends providing respective edges 21 and 22. The edges maybe integrally formed with the slats or separate side rails attached thereto as for example illustrated in FIGS. 5A, 5B, 5C, and 13 and to be described hereinafter. Connectors 18A that are of reduced thickness (obviously in pairs) facilitate tilting one slat relative to the next adjacent slat permitting contouring the unit as maybe desired. An important feature of this invention is the ability to design various portions of seats and/or backs and related surfaces, to have different degrees of resilience and/or contour. By varying the width and/or depth of the slats 11, different degrees of resilience can result when a whole seat/back unit is machined or molded with uniform thickness. Half inch thick slats, one inch wide are far more resilient than slats of the same thickness which are 1.5 inches wide. By this means the thighs of an occupant can be supported firmly while the same person's buttocks encounter a more yielding surface and the upper back can be supported less firmly than the lower back of the occupant. Fine tuning can achieve a variety of ergonomic benefits.

Figure 4:
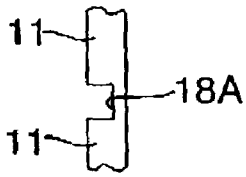
FIG. 4 is a side view of a portion of FIG. 3.

FIG. 4, a side view of a portion of the unit shown in FIG. 3 illustrates a connector 18A that is of reduced thickness between two adjacent slats and which interconnects the same.

Figure 5A:
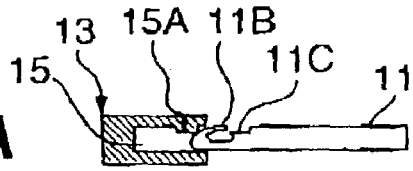
FIGS. 5A, 5B, and 5C are each vertical sectional views showing an end portion of a slat at different stages during attachment thereof to a support.
Figure 5B:
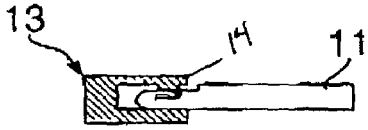
Figure 5C:
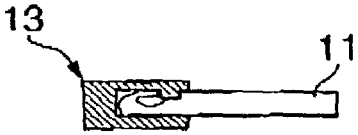

FIGS. 5A, 5B, and 5C are vertical sections through a slat support 13 that maybe a rail or other structural support and in the illustrated form maybe considered a rail. The groove 15 in the support is seen in cross-section and from which it will be noted the throat into the groove is narrower than the groove due to a downwardly projecting lip 15A. The slat 11 has a finger 11A projecting outwardly from the end thereof. The finger is U-shape in side elevational view and terminates in a free upper outer end 11B. At the beginning of insertion of the finger 11A into the groove 15, as seen from FIG. 5A, there is an interference fit because of the depth of the folded finger 11A being greater than that of the throat opening. Upon further insertion the folded over finger 11A is depressed as seen from FIG. 5B. When the end of the slat is fully inserted into the groove, as seen in FIG. 5C, the folded finger 11A snaps back and the finger terminal end 11B is in engagement with the bottom face portion of the rail forming a longitudinal rib 14 extending the length thereof whereby the lateral edge of the rib forms an edge or lip 15A cooperatively engaging the groove 15 thereby locking the slat in the groove 15 of the support. The resiliency of the material causes the formation on the end of the slat to a snap back into a locked position. At the juncture of the finger 11A and slat 11 there is a step down providing a recessed flat face 11C. In an assembled state, as seen in FIG. 5C the flat face 11C engages a lower face of the rib 14.

The member 13 shown in FIG. 5 maybe the support illustrated in FIG. 1 or the marginal edges 21 and 22 of the unit shown in FIG. 3.

Figure 6:
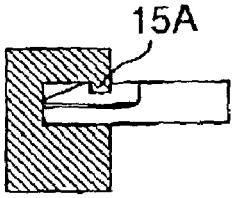
FIG. 6 is a vertical sectional view illustrating a snap lock connection of one end of a slat and a portion of the support part of the furniture.
Figure 7:
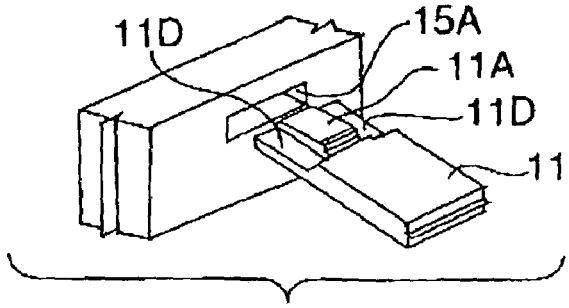
FIG. 7 is an exploded perspective view of the components of FIG. 6 illustrating the interconnecting portions of one end of a slat and a portion the supporting structure.
Figure 8:
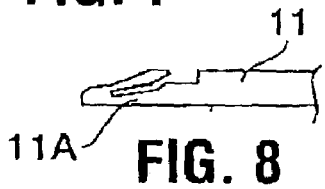
FIG. 8 is a vertical sectional view of an end portion of a slat showing an elongate locking finger on one end thereof.
Figure 9:
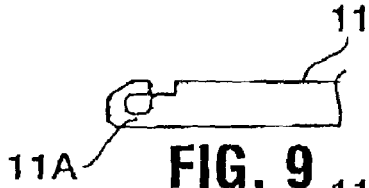
FIG. 9 is similar to FIG. 8 and shows an open area into which the finger is crushed during insertion of the end of the strap into a recess in the support member.
Figure 10:
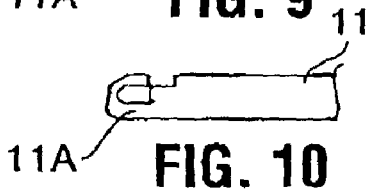
FIG. 10 is similar to FIG. 8 and illustrates the open area to receive the finger during assembly of the furniture.

FIGS. 6 to 10, illustrate a cavity, for example, cavity 16 in FIG. 1, in a slat support structure 13. The cavity has a lip 15A providing a restriction at the entry into the cavity. The end of the slat has a reversely bent or U shaped finger portion 11A intermediate a pair of flat planar faces 11D. FIG. 6 illustrates the slat end and support in an assembled interlocked state and FIG. 7 shows the end of the slat prior to insertion into the cavity. FIGS. 8 to 10 illustrate different forms of a folded upon itself finger on the end of the slat. The central finger is a catch deployed between two flat faces 11D the latter of which stabilize the joint. FIG. 8 illustrates the crush lock methodology.

Figure 11:
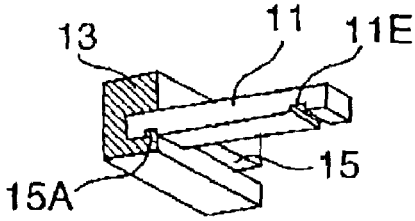
FIG. 11 is a perspective view showing an alternative embodiment of a slat and support in an assembled state.

Referring to FIG. 11 there is illustrated a slat 11 having simply a groove 11E disposed transverse to the length of the slat and in one face thereof. There is one such groove adjacent each of the opposite ends of the slat. The groove 11E is suitably dimensioned and so located such that the end of the slat can slidably fit into the groove 15 with the groove 11E receiving therein the lip 15A in the groove 15.

Figure 12:
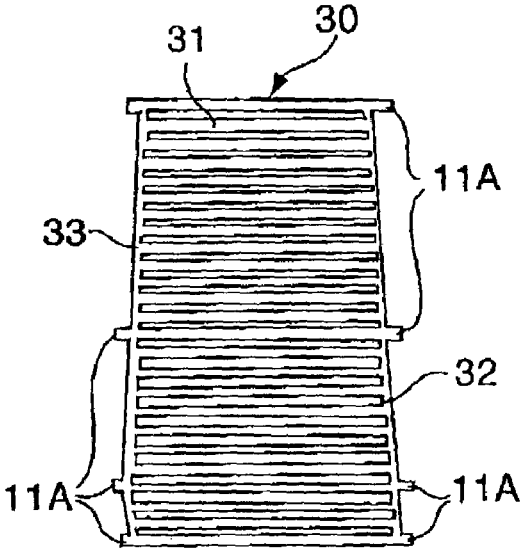
FIG. 12 is a face view of a seat and/or back portion of a piece of furniture consisting of a plurality of parallel straps spaced apart from one another and means along opposed marginal edges that connect to co-operating means on support members of the piece of furniture.

Referring to FIG. 12 there illustrated a unit 30 that is a combined seat and back for a piece of furniture. The unit comprises a plurality of spaced apart slats 31 joined together at marginal edges 32 and 33. Projecting outwardly from these marginal edges and at positions spaced longitudinally therealong are attachment fingers 11A as shown in FIG. 5 or 7 or the equivalent there of.

Figure 13:
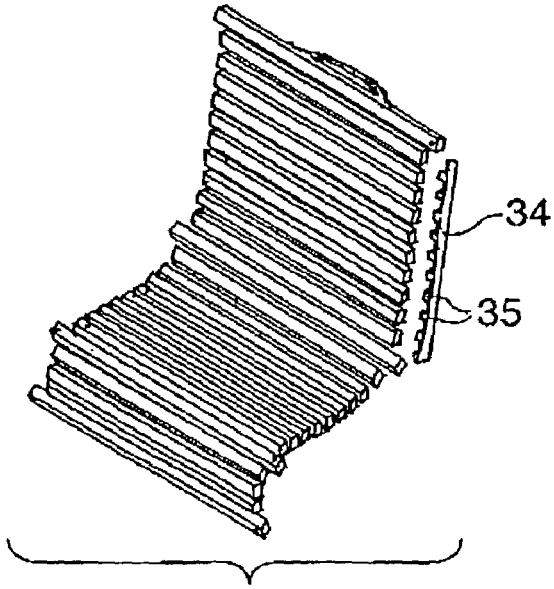
FIG. 13 is perspective view of a seat and/or back similar to FIG. 12 but of different construction.

FIG. 13 is a perspective of the unit shown in FIG. 12 but in which the common edge 32 (only one of the two marginal edges is shown but both would be the same) is replaced by a separate rail 34 having a series of slat spacers 35 projecting therefrom.

Figure 14:
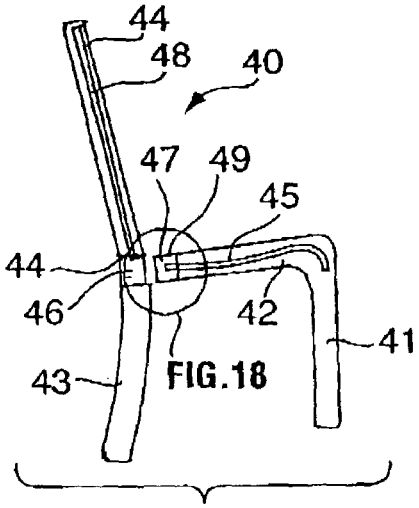
FIG. 14 is vertical view of a chair component incorporating components and interconnection thereof as provided in accordance with the present invention.
Figure 15:
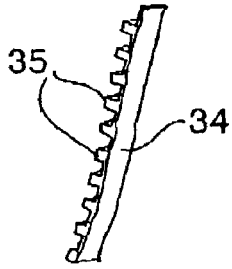
FIG. 15 is a side view of a slat connector strip.
Figure 18:
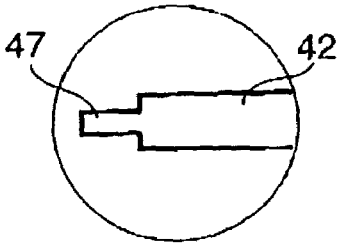
FIG. 18 is an enlargement, in plan view, of a portion of the encircled area of FIG. 14 at the juncture of the chair seat and chair back.

FIG. 14 is a vertical side elevational view of a chair portion 40 showing a front leg 41 and seat support unit 42 detached from a vertical member that provides a rear leg 43 and back support 44. There is a groove 45 in a side face of the seat support portion 42 suitable for receiving the connecting end portion of seat slats. At the juncture of the rear leg 43 and back support 44 there is a mortise 46 to receive a tenon 47 on the end of the seat support 42. There is a groove 48 (corresponding to groove 15 previously described) in a side face of the chair back support 44. When groove 48 is filled with a common set of slats, the lower most one fills a locking notch 49 to lock the tenon 47 into the mortise 46.

Figure 16:
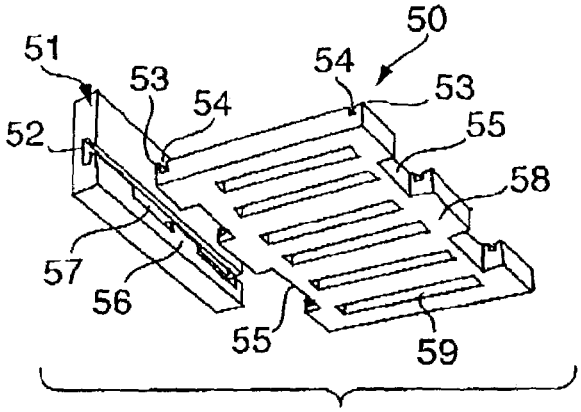
FIG. 16 is a bottom perspective exploded view illustrated the underside of an end portion of a chair seat and seat support rail.

FIG. 16 is a perspective view looking up under a seat 50 and a portion of a seat support rail 51 illustrating a further embodiment of a locking relationship between slats and a support therefore. The locking portion of the support 51 of a seating structure such as a chair, chaises lounge, bench, table, chest, etc. has a locking groove 52 to capture and hold captive locking fingers 53 on the edge of the seat. There is a notch 54 in the seat member 50. The seat member has slits 59 appropriately located for appearance and/or providing a desired selected resilience. In this optional embodiment of the invention, the common locking edge of the seat and/or back or other support structure is interrupted with indents 55 providing spaced apart projections or support blocks 58 which engage blocks 56 on support 51 when the parts are assembled and in a locked into position state. This accomplished by inserting seat 50 sideways until locking fingers 53 enter into locking notches, are then pushed upward until locking notch 53 occupies the upper portion of locking notch or groove 52 after which the seat 50 is slid horizontally until support blocks 58 rest on top of blocks 56 thus to comprise a fully lock relationship between the seat and the seat support 51.

Figure 17:
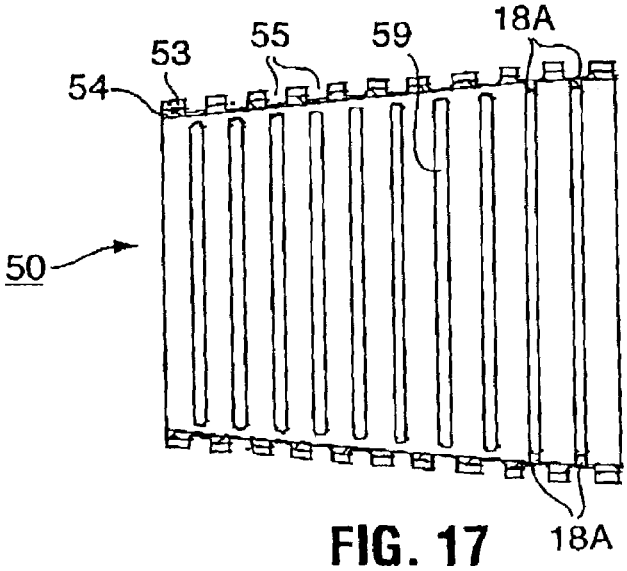
FIG. 17 is plan view of a series of interconnected parallel slats providing a chair seat and/or chair back with end projections for connecting the same to a support structure portion to the piece of furniture.

FIG. 17 is a plan view of the seat 50 shown in FIG. 16, with corresponding numbers, showing the locking notch 54, locking fingers 53, slits 59, side notches 55, and adds a view of a connector 18A of reduced thickness which permits easy bending of the two slates shown on the right side of the part to a different angle such as vertical when the seat is horizontal or to the horizontal when the part is configured as a primarily vertically oriented chair back.

Figure 19:
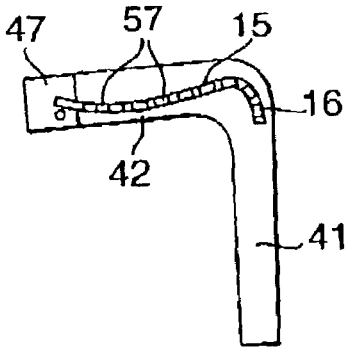
FIG. 19 is an elevational view of a chair leg and seat rail showing further detail.

FIG. 19 is an elevational view of the chair leg/rail 41, 42 of FIG. 14 differing therefrom in that there are alternating notches 57 as in FIG. 16 for a seat support member.

Figure 20:
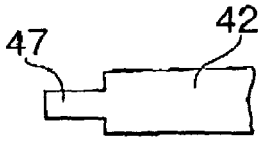
FIG. 20 is a plan view of a tenon on the end of the chair rail that attaches to the chair back and corresponds essentially to FIG. 18.

FIG. 20 is a plan view of the tenon 47 on the end of the seat support 42 shown in FIG. 19 and is essentially the same as FIG. 14.

Figure 21:
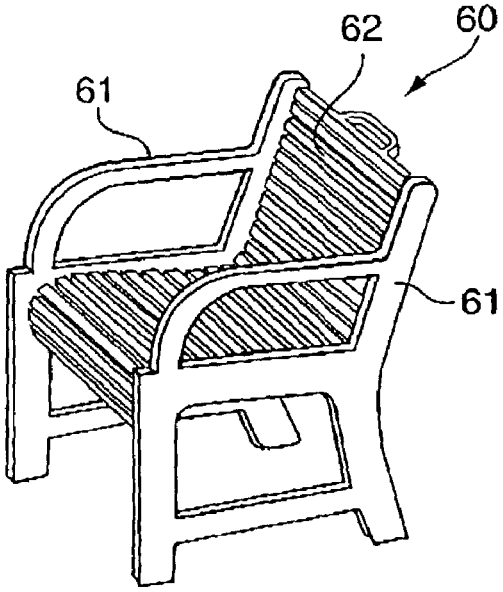
FIG. 21 is an oblique view of an arm chair incorporating components and interconnection thereof illustrated in the various foregoing figures.

FIG. 21 is a perspective view of an arm chair 60 comprising a space apart pair of members 61, each of which is substantially planar, providing arms, legs, back support and leg stretcher. Each of these members is either machined from a single panel of sheet goods or is assembled from individual components. A unit 62 of slats provides the seat and back for the chair and maybe assembled and connected to the supports in a manner as described in the foregoing.

Figure 22:
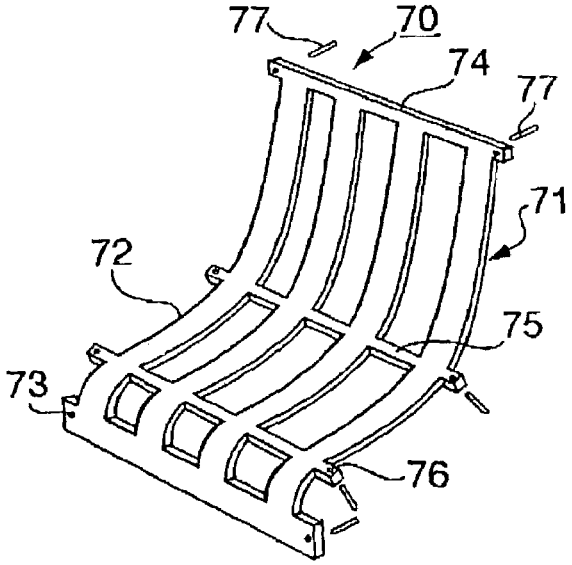
FIG. 22 is an oblique view of a chair seat and chair back component having a seat support rail on the lower end thereof.

FIG. 22 is a perspective view of a unit 70 which is a chair back 71, chair seat 72 and a seat support rail 73. The unit attaches to the support structure by a slat 74 at the top, a slat 75 in the middle and optionally a slat 76 at the front of the seat and one below the member 73. These slats attach via pins 77 or by any of the means described herein. The novelty here is that these straps form a relatively small portion of the surface making up the seat or back of the structure. Most of the contact points with the body are sling members which are substantially perpendicular to said slats. The result is a sling configuration which offers a different approach to comfort and make possible the use of the present invention in designs which requires this orientation for any reason.

Figure 23:
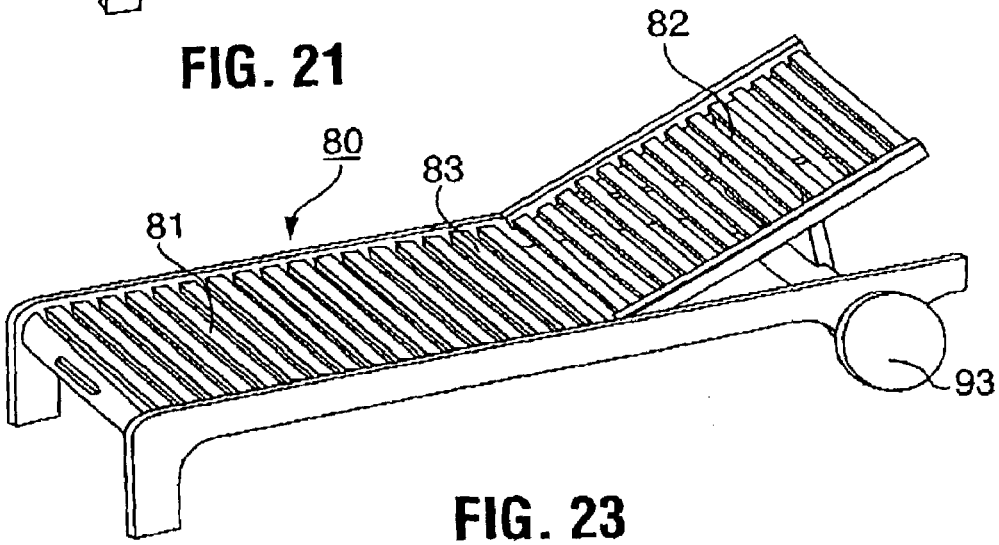
FIG. 23 is an oblique view of a chaise lounge type chair incorporating chair components and interconnections thereof provided in accordance with the present invention.

FIG. 23 is a perspective view of an elongate chair 80 known as a chaise lounge. There is a seat portion 81 that is contiguous with a back member 82. At the juncture of the seat and back there is a thinned portion that functions as a continuous hinge 83 permitting the raising and lowering of the back to various angles without the use of other pivoting hardware and to provided bending of other element during assembly.

Figure 24:
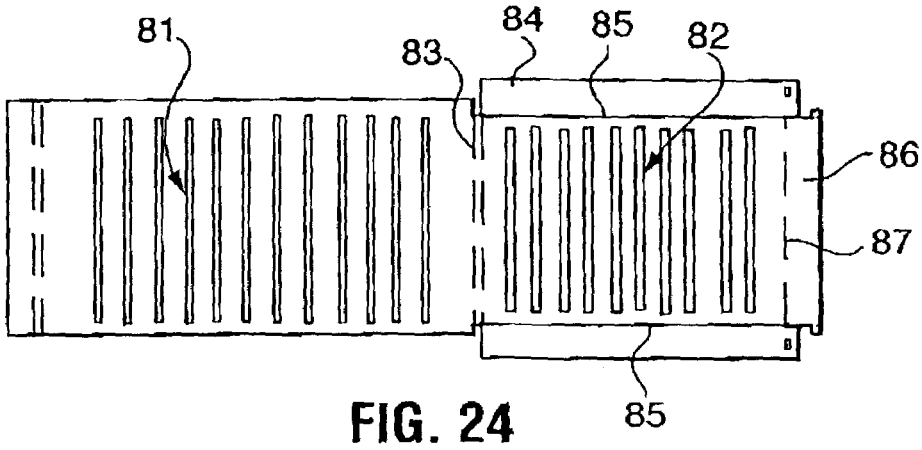
FIG. 24 is a plan view the seat and chair back of the chair illustrated in FIG. 23.

FIG. 24 shows the seat 81 and back 82 of FIG. 23 in plan view but with added integral back support flaps 84 connected via areas of reduced thickness functioning as a continuous hinge 85 and an end flap 86 connected via hinge line 87. The arrangement is one of simplicity for manufacture especially when cut from sheet goods using a CNC router.

Figure 25:
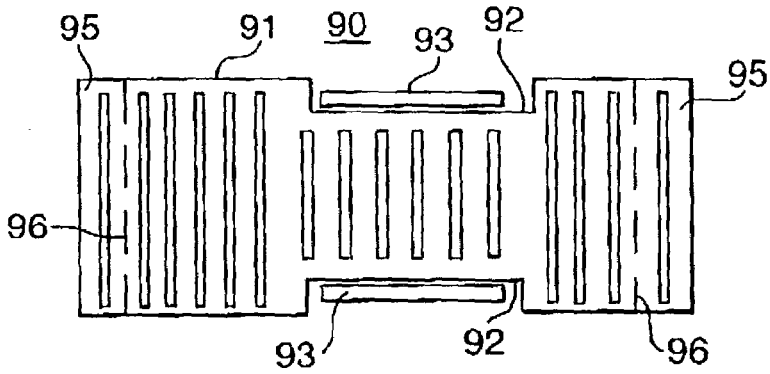
FIG. 25 is a plan view of a unit for a chaise lounge to provide a storage area.

FIG. 25 is a plan view of a structural storage compartment unit 90 for an elongated seating unit like the chaise lounge 80 of FIG. 23. The unit 90 has a series of slats joined by integral locking edges 91 that are indented on both sides as at 92 to permit space for the wheels 93 of the chaise lounge. A series of slats also serve as a lockable storage compartment below the back of the chaise lounge when flaps 95 are bent up along their thinned hinge lines 96 and installed as seen in FIG. 26.

Figure 26:
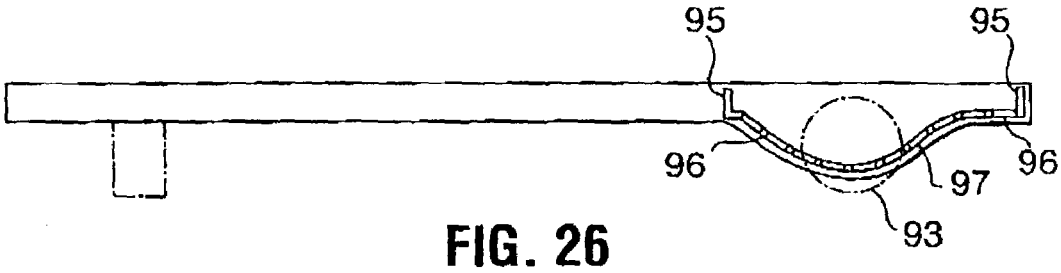
FIG. 26 is a partial side view of a chaise lounge having the unit of FIG. 25 mounted thereon and providing a storage area.

FIG. 26 is an elevational view of a portion of a chaise lounge having the unit 90 of FIG. 26 in place thereon with the flaps 95 upturned. There is a downward bulge as at 97 giving valuable structural rigidity creating stiffening between the two sides of the chaise. With the added rigidity the cost of having a wheel to wheel axle can be avoided. The storage area is closed when the chaise back is fully down and suitable locking means can be readily attached.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented hereinabove. Rather, what is intended to be covered is within the spirit and scope of the appended claims.

I claim:

1. A furniture structure formed of components that snap-fit together to provide a rigid assembled structure, said furniture structure comprising:

a pair of support members, a plurality of interconnected slats forming a single integrally formed rigid unit having at least opposing side edges comprising end projections that provide a load carrying surface between said support members and means connecting said end projections of said slats to said support members for snap-fit inter-engagement therewith and simultaneously rigidifying the assembled structure, said connecting means comprising a cavity in each of said support members and a finger projecting from opposite ends of at least one of each said slats and opposed edge of a group of interconnected slats, said cavities each having a rib extending across an entry there into providing a restricted throat entry area into the cavity associated therewith and wherein each said finger comprises a first section corresponding in depth to the throat opening and a U-shape resiliently deformable section projecting from said first section, said U-shape section having a depth greater than the restricted throat entry whereby upon insertion of the finger into the cavity a terminal free outer end of the finger, as it passes the rib, snaps to lockably engage such rib, said first area being in close fit engagement with said restricted throat opening and thereby rigidifying the assemble structure.

2. The furniture structure as defined in claim 1 wherein said slats are rectangular in cross-section.

3. The furniture structure as defined in claim 1 wherein said finger first section has a flat surface and wherein said flat surface engages said rib.

4. The furniture structure as defined in claim 3 wherein said flat section extends laterally beyond said U-shape finger section.

5. The furniture structure as defined in claim 1 wherein said slats are rectangular in cross-section and wherein said finger first section has a flat surface that engages said rib.

6. The furniture structure as defined in claim 5 wherein said first section is thinner than the remainder of the slat providing means for tilting said integral unit of rigid slats for bending same around a corner.

7. The furniture structure as defined in claim 1 wherein said support member is substantially planar.

8. The furniture structure as defined in claim 1 wherein each cavity in said support member is an elongate groove including at least a portion wherein a top portion of said groove defines a first lip extending outwardly equidistance to a bottom portion of said groove defining a second lip.

9. The furniture structure as defined in claim 8 wherein said groove is a straight line.

10. The furniture structure as defined in claim 8 wherein said groove is curvilinear.

11. A furniture structure comprising a first and second pair of laterally spaced apart support members including at least one locking groove extending into a selected side wall of said support members a selected depth cooperatively engaging end projections of a plurality of rigid slats disposed between said support members, said plurality of rigid slats are interconnected and disposed in parallel side-by-side relationship providing an integral chair and back unit, and means rigidly and snap-fittingly connecting said rigid slats to respective ones of said support members, said rigid slats being made of a material and so dimensioned as to provide the slats with a selected degree of resiliency whereby selected ones of the plurality of slats conform to selected areas on one's anatomy rendering it comfortable to an occupant resting on said rigid slats.

12. The furniture structure as defined in claim 11 wherein said support members are substantially planar members.

13. The furniture structure as defined in claim 12 wherein said planar members are substantially parallel to one another.

14. The furniture structure as defined in claim 11 wherein said connecting means comprises finger projecting from one of said slats and a plurality of slats joined together in a group and recesses in said support structures receiving therein said fingers, said fingers and recesses being in close fitting relation providing a rigid assembled structure.

15. A furniture structure comprising a first element that includes a plurality of rigid slats disposed in spaced apart parallel relationship said plurality of rigid slats are interconnected forming an integral unit having opposing side edges comprising end projections for cooperatively engaging a second element comprising a first and second pair of laterally spaced apart support members including at least one locking groove extending into a selected side wall of said support members a selected depth cooperatively engaging end projections, said support members defining a pair of spaced apart supports disposed substantially vertically, said first element being disposed between said pair of supports and means snap fittingly and rigidly connecting said first element to each of said supports to thereby provide a stable load supporting structure, said slats being made of a material and so dimensioned as to have selected resiliency.

16. The structure as defined in claim 15 wherein said first element includes first and second contiguous sections angularly disposed with respect to one another.

17. The structure as defined in claim 16 wherein said contiguous sections provide a seat and a section extending downwardly from a forward leading edge of the seat.

18. The structure as defined in claim 16 wherein said contiguous sections define respectively a seat and back of a chair.

* * * * *